US010357707B1

(12) United States Patent
Aristizabal

(10) Patent No.: US 10,357,707 B1
(45) Date of Patent: Jul. 23, 2019

(54) HEXAGONAL BOARD GAME

(71) Applicant: Andres Aristizabal, Pembroke Pines, FL (US)

(72) Inventor: Andres Aristizabal, Pembroke Pines, FL (US)

( * ) Notice: Subject to any disclaimer, the term of this patent is extended or adjusted under 35 U.S.C. 154(b) by 0 days.

(21) Appl. No.: 15/996,429

(22) Filed: Jun. 1, 2018

(51) Int. Cl.
*A63F 3/00* (2006.01)

(52) U.S. Cl.
CPC ..... *A63F 3/00261* (2013.01); *A63F 3/00006* (2013.01); *A63F 3/00176* (2013.01); *A63F 2003/00195* (2013.01); *A63F 2003/00264* (2013.01)

(58) Field of Classification Search
CPC ..... A63F 3/00261; A63F 3/00176; A63F 3/00006; A63F 2003/00264; A63F 2003/00195
USPC ..... 273/243, 275, 282.1, 282.3, 283, 287
See application file for complete search history.

(56) References Cited

U.S. PATENT DOCUMENTS 2,162,876 A * 6/1939 Barton ..... A63F 3/00097 273/242
3,309,092 A * 3/1967 Hardesty ..... A63F 3/00097 273/157 R
3,695,615 A * 10/1972 Shoptaugh ..... A63F 3/00097 273/157 R
4,190,256 A * 2/1980 Rudden, Jr. ..... A63F 3/00097 273/275
4,828,268 A * 5/1989 Somerville ..... A63F 3/00075 273/283
4,941,611 A * 7/1990 Arsenault ..... A63F 3/00634 238/10 A
5,018,743 A * 5/1991 Maier ..... A63F 3/00097 273/153 S
5,692,749 A * 12/1997 Vogeler ..... A63F 9/0669 273/157 R
6,431,547 B1 * 8/2002 Arkoosh ..... A63F 3/00697 273/264
6,460,856 B2 * 10/2002 Davies ..... A63F 3/00097 273/275

* cited by examiner

*Primary Examiner* — Vishu K Mendiratta
(74) *Attorney, Agent, or Firm* — Ruben Alcoba, Esq.

(57) ABSTRACT

A hexagonal board game that is arranged in a pattern that is similar to a honeycomb. The board game consists of 37 tiles wherein 16 of the tiles have a first pattern, 15 of the tiles have a second pattern and 6 of the tiles have a third pattern. The tiles having the first pattern define three distinct linear paths in which each path has a set of landing spots within the paths. The tiles having the second pattern define two distinct linear paths in which each path has a set of landing spots within the paths and two paths that go nowhere. The tiles having the third pattern have a path that connects all sides. Yet the tiles have a blockade in the central axis point of the tiles. The first, second and third pattern tiles are set on the frame of the board game in a specific manner. The board game has a plurality of game pieces and includes a pair of dice. Players are given instructions as to how to traverse the board game, with their individual game pieces, from one side to the other in order to win the game.

4 Claims, 10 Drawing Sheets

HEXAGONAL BOARD GAME

BACKGROUND

The present invention is directed to a hexagonal board game that allows players to change the landscape of the board as the game is played.

The hexagonal board game of the present game is a game of strategy and of a small amount of luck that is played with dice.

The game calls for strategy, for the game provides a board that changes its board appearance upon the each player's turn.

The changing of the board appearance will allow players to block moves that can be made on the board by opposing players while facilitating their own moves.

Each game played on the board game of the present invention will have its own unique feel and strategy, so no strategy can be pre-calculated to win the game.

The game calls for players to think on the spot with regards to their present move and with regards to their opponents future moves.

The purpose of the game is to have a player start his player piece on one side of the hexagonal board game and to reach the other side of the board game. Player pieces can only be moved in linear paths that are within tiles of the games. The novelty of the game is that the paths are in constant flux and the flux is determined by the players of the game.

For the foregoing reasons there is a need for a hexagonal board game that requires players to strategize their every move, thereby improving their critical thinking abilities.

SUMMARY

The present invention describes a hexagonal board game that will improve players of the games critical thinking by having them strategize their every move in the game.

The present invention is a hexagonal board game that is arranged in a pattern that is similar to a honeycomb. The board game consists of 37 tiles, wherein 16 of the tiles have a first pattern, 15 of the tiles have a second pattern and 6 of the tiles have a third pattern, the tiles are placed on a frame that consists of 37 receptacles. The tiles having the first pattern define three distinct linear paths in which each path has a set of landing spots within the paths. The tiles having the second pattern define two distinct linear paths in which each path has a set of landing spots within the paths and two paths that go nowhere. The tiles having the third pattern have a path that connects all sides, yet the tiles having the third pattern define a blockade in the central axis point of the tiles. The first, second and third pattern tiles are inserted within the hexagonal receptacles of the frame of the board game in a specific manner. The board game has a plurality of game pieces and includes a pair of dice. Players are given instructions as to how to traverse the board game, with their individual game pieces, from one side to the other in order to win the game.

An object of the present invention is to provide a board game that is in constant flux, for the landscape of the game changes upon every roll of the dice of the players.

Another object of the present invention is to provide a board game that will improve each player's critical thinking.

DRAWINGS

These and other features, aspects, and advantages of the present invention will become better understood with regard to the following description, appended claims, and drawings where:

DESCRIPTION

Figure 1:
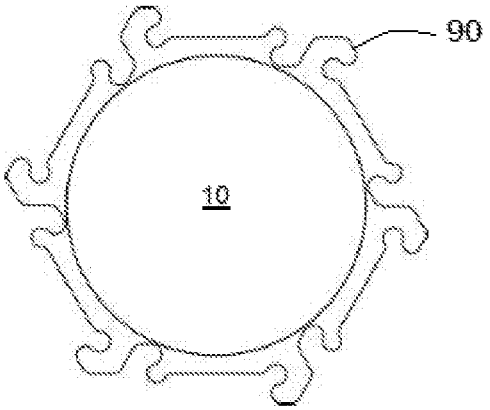
FIG. 1 is a top view of each receptacle of the frame of the present invention.
Figure 2:
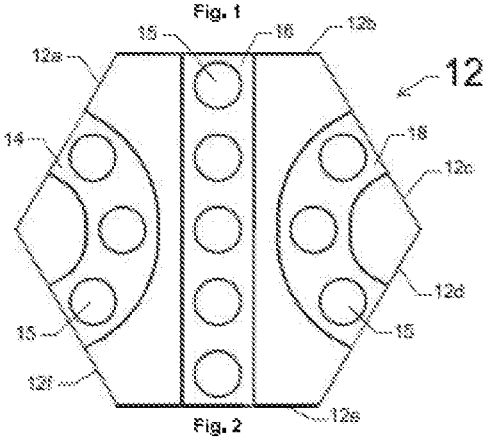
FIG. 2 is a top view of a first hexagonal tile that is placed within the receptacles of the present invention.
Figure 3:
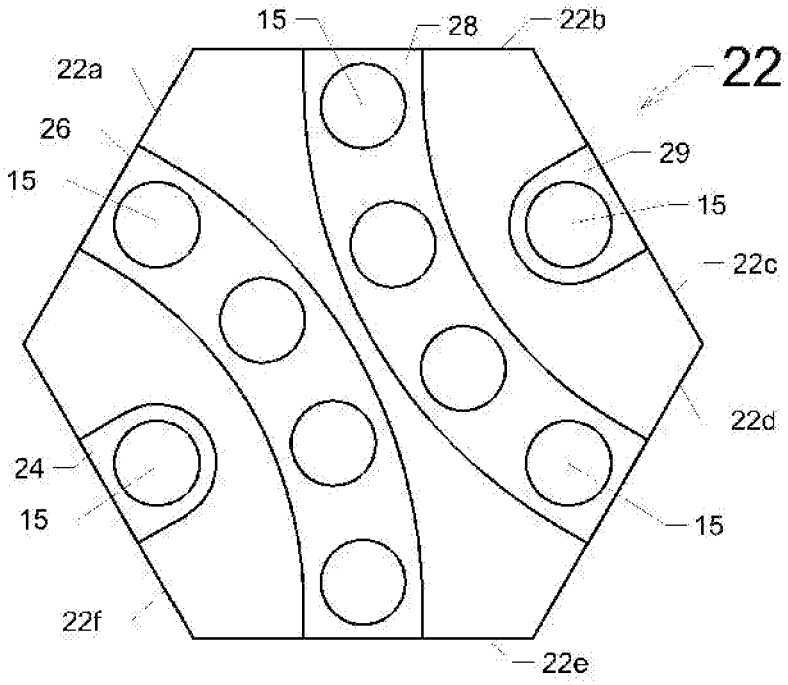
FIG. 3 is a top view of a second hexagonal tile that is placed within the receptacles of the present invention.
Figure 4:
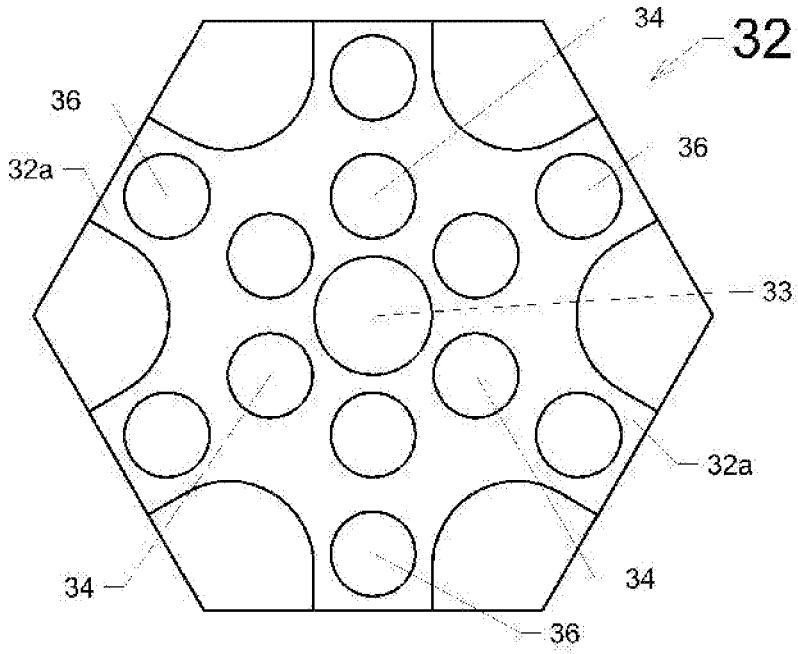
FIG. 4 is a top view of a third hexagonal tile that is placed within the receptacles of the present invention.
Figure 5:
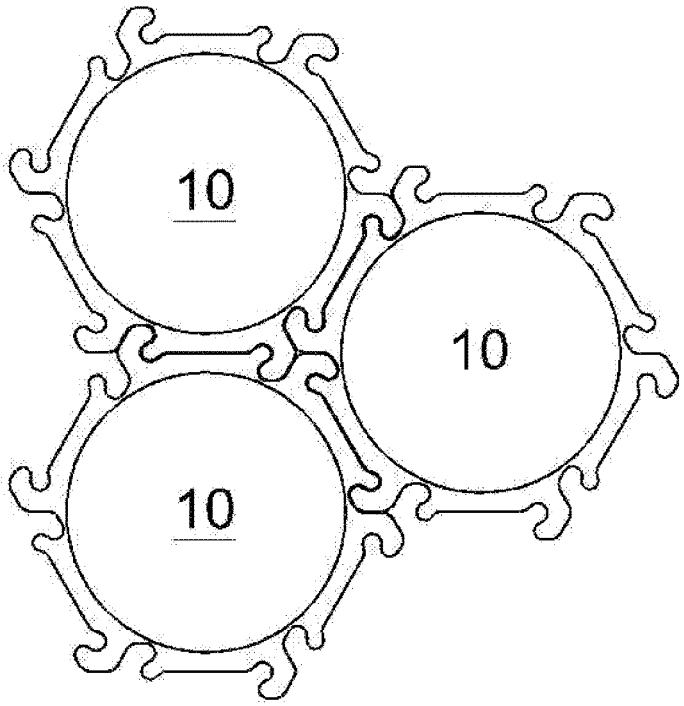
FIG. 5 is a top plan view that shows how three of the receptacles of the present invention are attached to each other.
Figure 6:
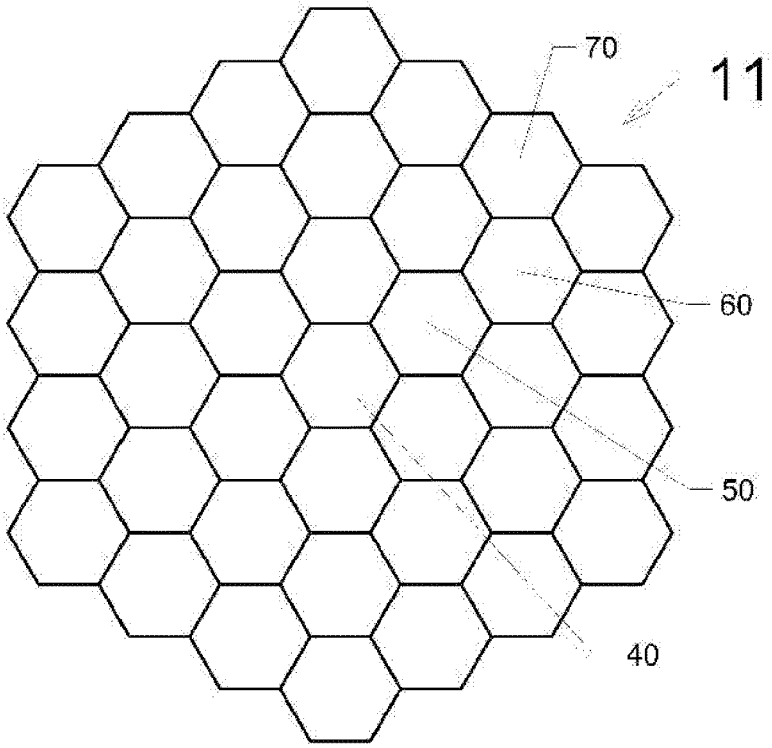
FIG. 6 is a top plan view that shows how all of the receptacles of the present invention are attached to each other to form the skeleton of the board game.
Figure 7:
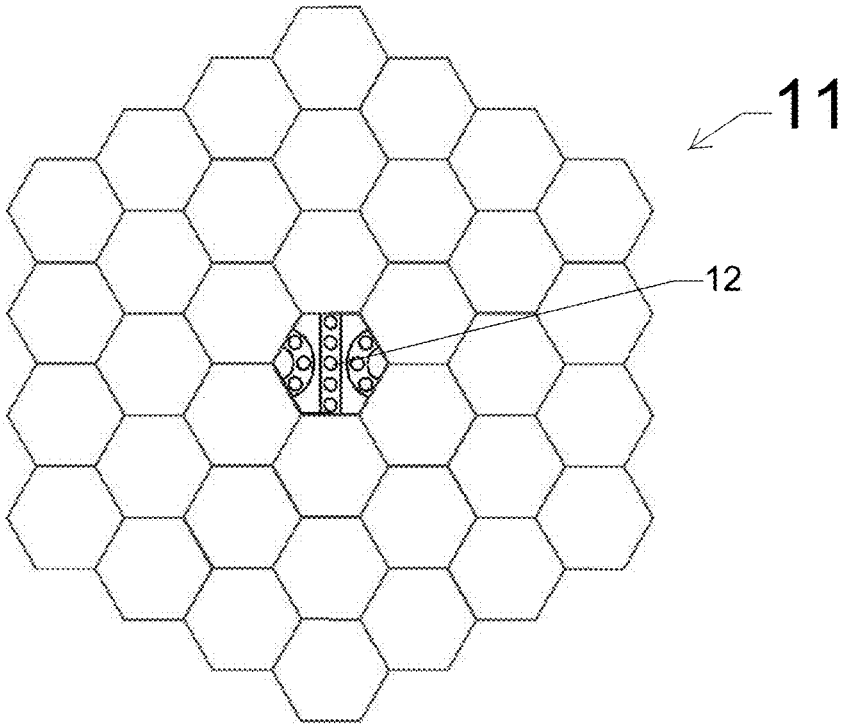
FIG. 7 is a top plan view that shows how one of the first hexagonal tiles is placed on the frame.
Figure 8:
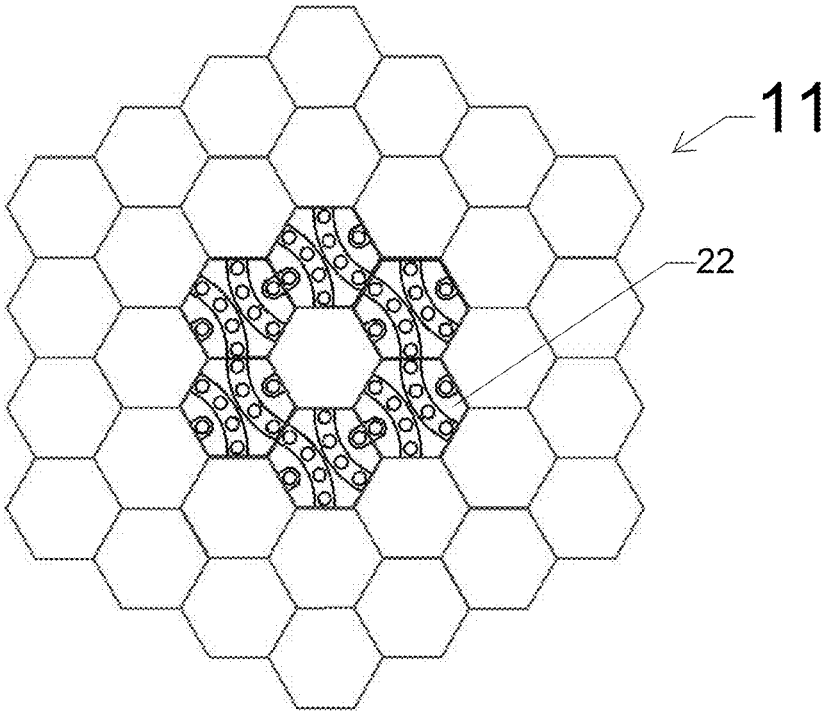
FIG. 8 is a top plan view that shows how a specific number of second hexagonal tiles are placed on the second layer of the board game.
Figure 9:
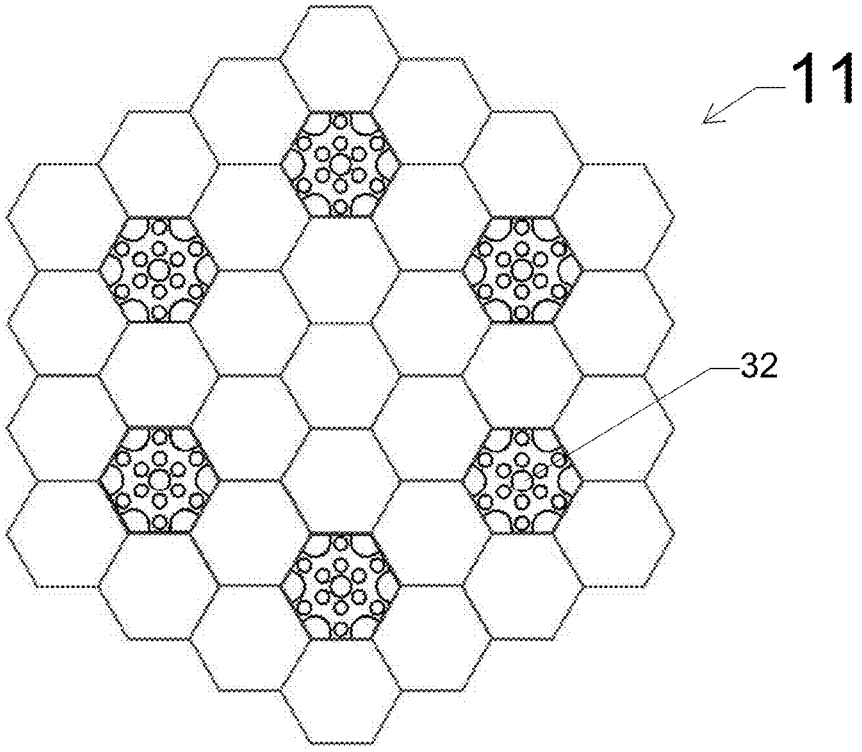
FIG. 9 is a top plan view that shows how a specific number of the third hexagonal tiles are placed on the third layer of the board game.
Figure 10:
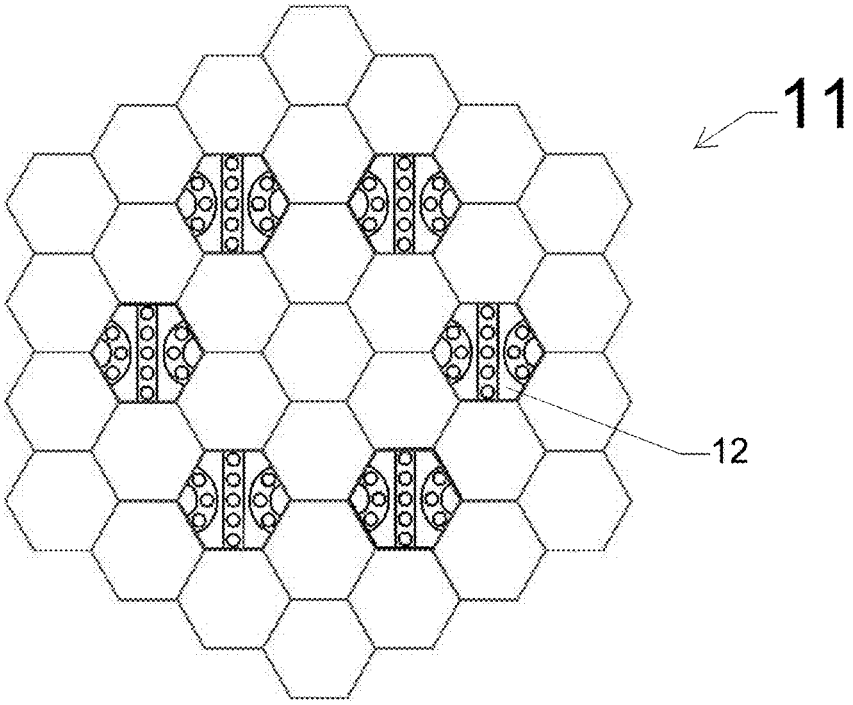
FIG. 10 is a top plan view that shows how a specific number of first hexagonal tiles are placed on the third layer of the board game.
Figure 11:
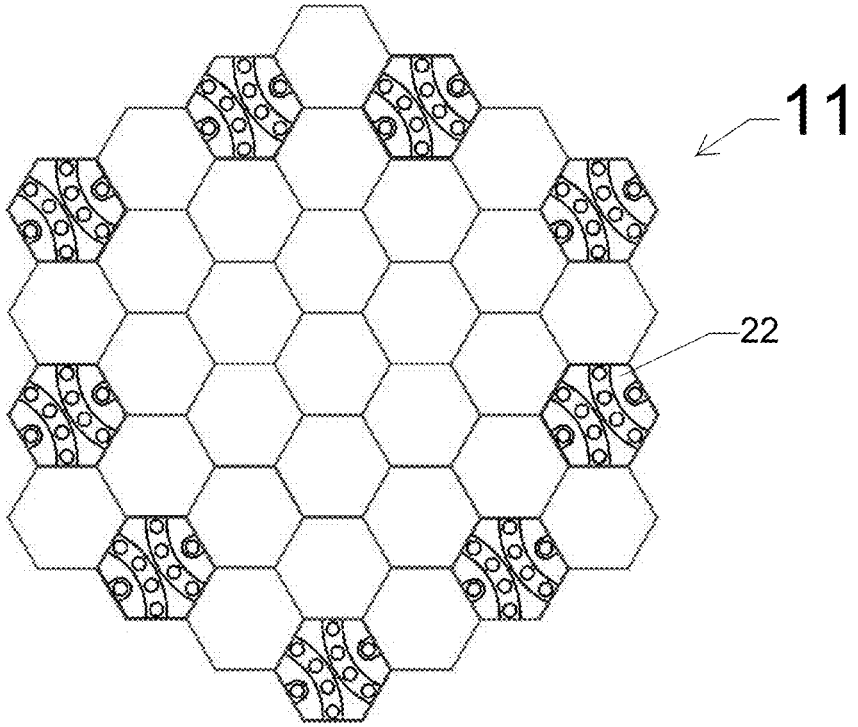
FIG. 11 is a top plan view that shows how a specific number of the second hexagonal tiles are placed on the fourth layer of the board game.
Figure 12:
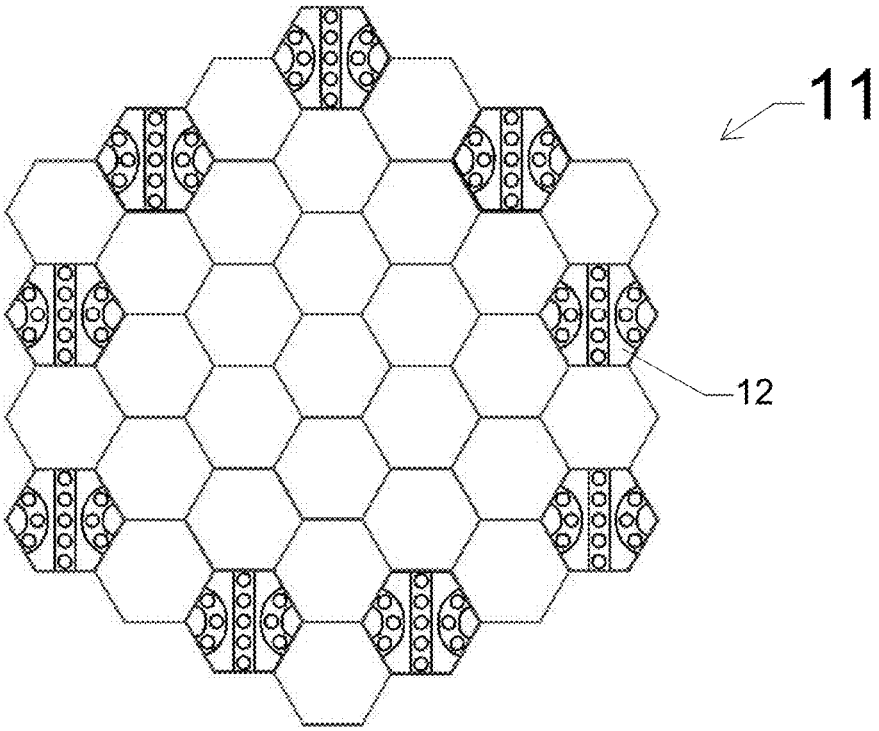
FIG. 12 is a top plan view that shows how a specific number of the first hexagonal tiles are placed on the fourth layer of the board game.
Figure 13:
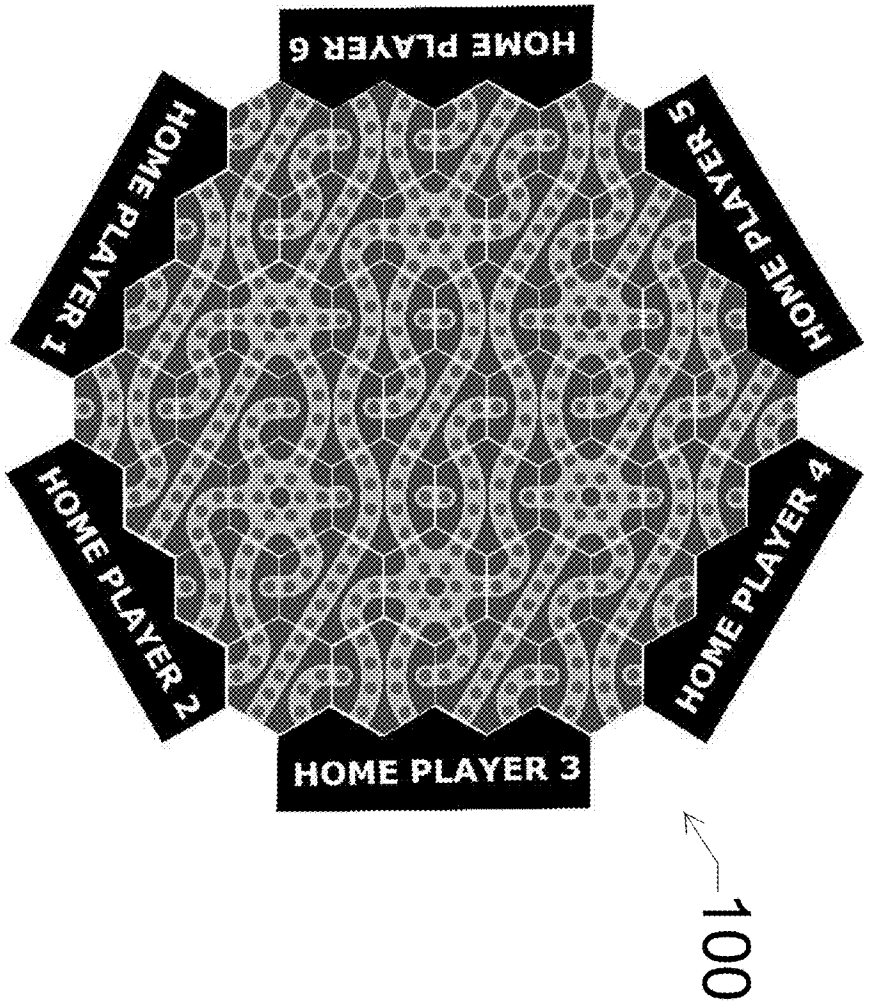
FIG. 13 is a top plan view that shows how all of the tiles would be placed on the board game.
Figure 14:
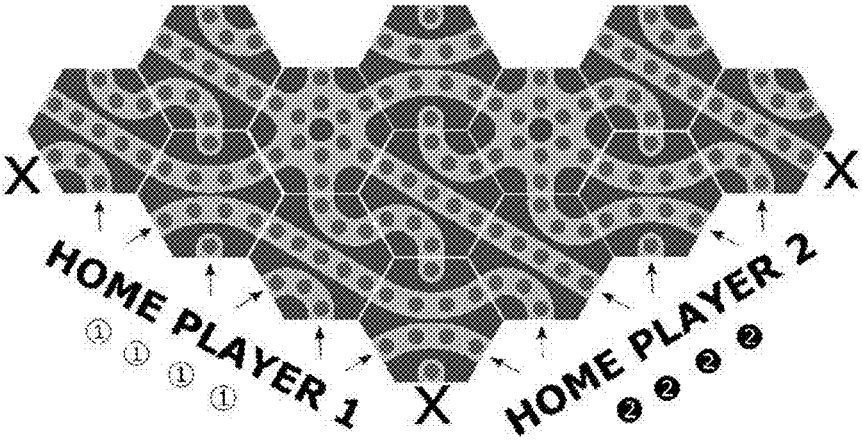
FIG. 14 is a top plan view that shows how each player could initiate their game pieces on the board game.
Figure 15:
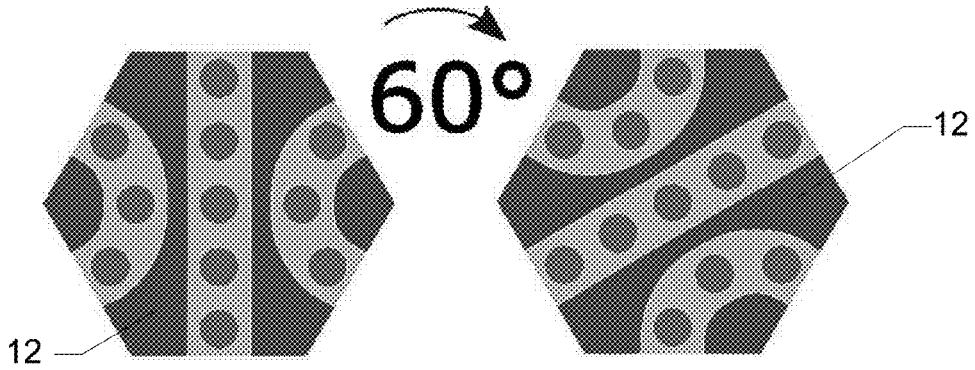
FIG. 15 is a top plan view that shows how each piece would be rotated upon each player's roll of the dice.
Figure 16:
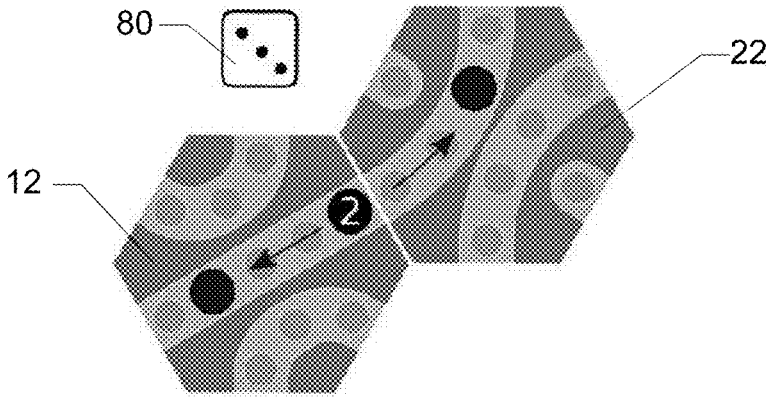
FIG. 16 is a top plan view that shows how a game/player piece could be advanced based on a each player's roll of the dice, note each game piece can be moved in two linear directions.
Figure 17:
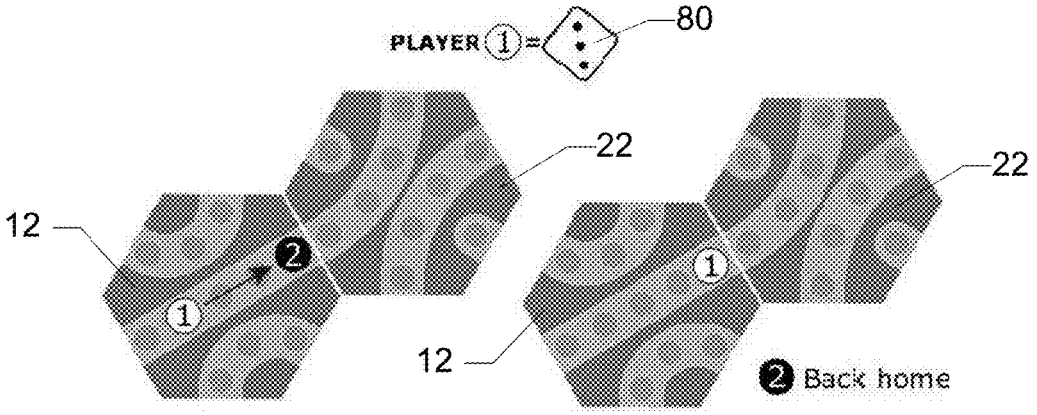
FIG. 17 is a top plan view that shows how a game piece would eat another player's game piece.
Figure 18:
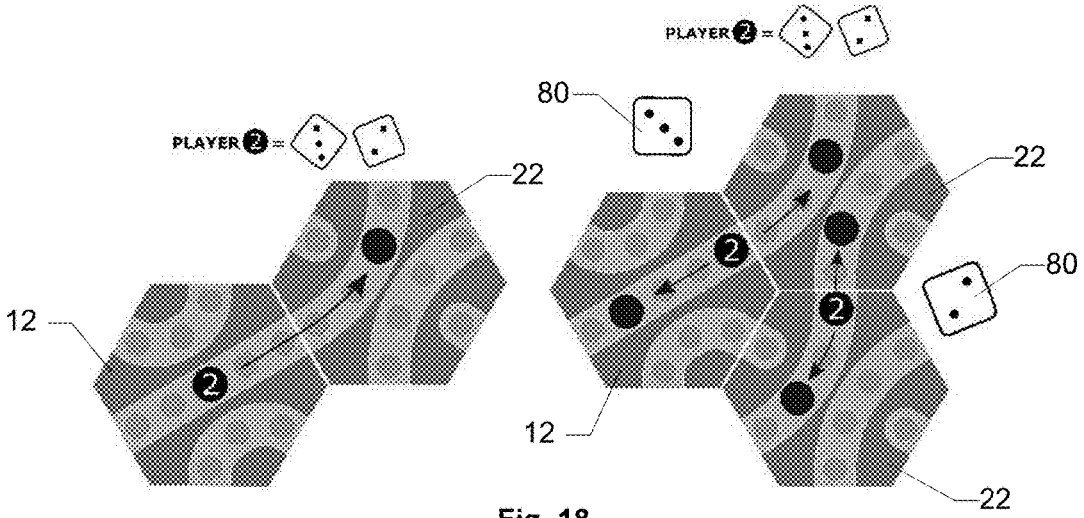
FIG. 18 is a top plan view that shows how a game piece can be moved on the landscape of the board game.
Figure 19:
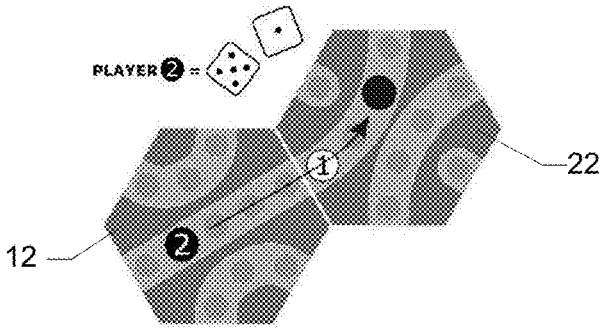
FIG. 19 is a top plan view that shows how a game piece is moved on the board game based on two dice.
Figure 20:
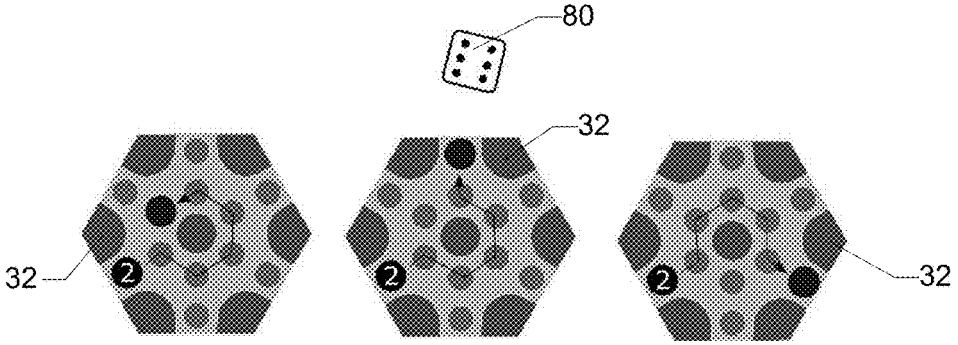
FIG. 20 is a top plan view that shows how a game piece is maneuvered around the third hexagonal tiles.
Figure 21:
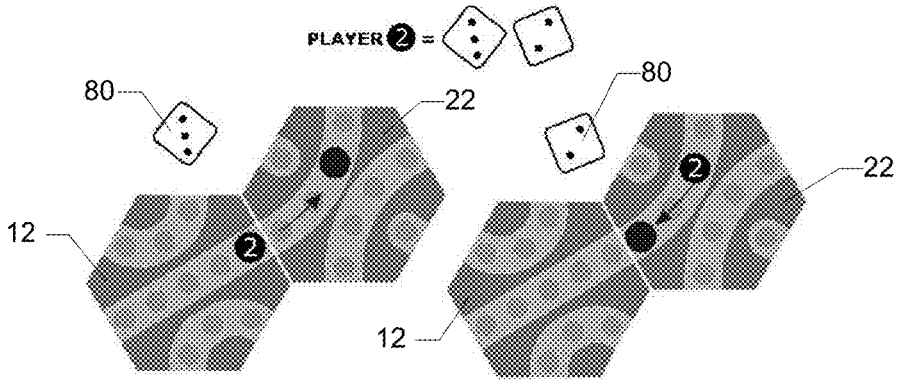
FIG. 21 is a top plan view that shows how a game piece can be moved in a forward linear path based on one dice and backward linear path based on the other dice.
Figure 22:
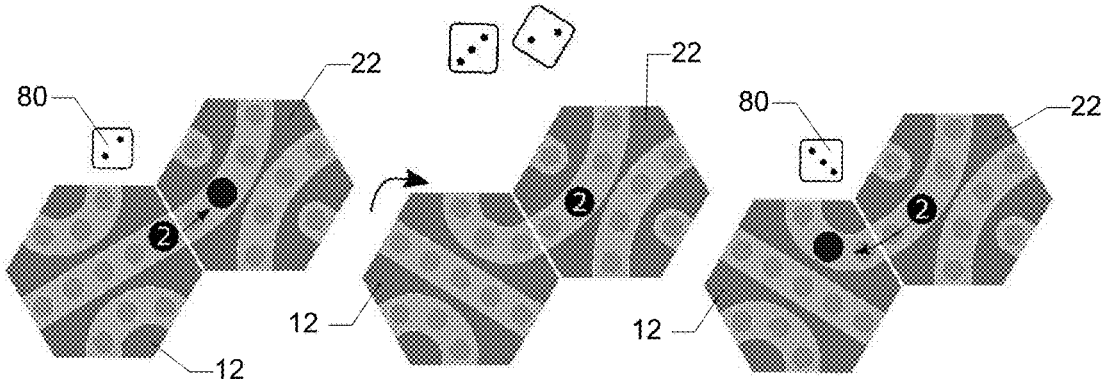
FIG. 22 is another top plan view that shows how a game piece can be moved in a forward liner path, rotate a tile to change the path, and then move in a backward linear path based on the roll of the second dice.

As seen in FIGS. 1-22, the present invention is directed to a hexagonal board game that is placed with dice. The hexagonal board game 100, the game comprises a frame 11 that defines thirty seven hexagonal receptacles 10, wherein the receptacles 10 are connected to each other in a honeycomb pattern, each hexagonal receptacle 10 defines interlocks 90 and the interlocks 90 are used to connect the hexagonal receptacles 10 to each other when setting up the frame 11, the frame 11 upon being set up defines thirty seven tile place holders/hexagonal receptacles, the receptacles are connected in the fallowing manner, a first receptacle 10 is the central axis and first layer 40, six receptacles 10 are attached to the first layer 40 forming a second layer 50, twelve receptacles 10 are attached to the second layer 50 forming a third layer 60, and eighteen receptacles 10 are attached to the third layer 60 forming a fourth layer 70. Sixteen first hexagonal tiles 12, each first hexagonal tile 12 has a top left 12*a*, a top 12*b*, a top right 12*c*, a bottom right 12*d*, a bottom 12*e*, and a bottom left side 12*f*, and wherein each first hexagonal tile 12 comprises of a first path 14 that defines three linear landing spots 15 and the first path starts on the top left side 12*a* and ends on the bottom left side 12*f* of each first hexagonal tile 12, a second path 16 that defines five linear landing spots 15 and the second path 16 starts on the top side 12*b* and ends on the bottom side 12*e* of each first hexagonal tile 12, and a third path 18 that defines three linear landing spots 15 and the third path 18 starts on the top right side 12*c* and ends on the bottom right side 12*d* each first hexagonal tile 12, and wherein the first hexagonal tiles 12 are placed on the frame 11 at the following locations of the frame 11: one first hexagonal tile 12 is placed in the first layer receptacle 40; six first hexagonal tiles 12 are placed in the third layer 60 receptacles so that a free third layer receptacle separates each first hexagonal tile 12; and nine first hexagonal tiles 12 are placed in the fourth layer 70 receptacles so that a free fourth layer 70 receptacle separates each first hexagonal tile 12 on the fourth layer 70. Fifteen second hexagonal tiles 22, each second hexagonal tile 22 has a top left 22*a*, a top 22*b*, a top right 22*c*, a bottom right 22*d*, a bottom 22*e*, and a bottom left side 22*f*, and wherein each second hexagonal tile 22 comprises of a first path 24 that defines one landing spot 15 and the first path 24 starts and ends on the bottom left side22*f* of each second hexagonal tile 22, a second path 26 that defines four linear landing spots 15 and the second path 26 starts on the top left side 22*a* and ends on bottom side 22*e* of each second hexagonal tile 22, a third path 28 that defines four linear landing spots 15 and the third path 28 starts on the top side 22*b* and ends on the bottom right side 22*d* of each second hexagonal tile 22, and a fourth path 29 that defines one landing spot 15 and the fourth path 29 starts and ends on the top right side 22*c* of each second hexagonal tile 22, and wherein the second hexagonal tiles 22 are placed on the frame 11 at the following locations of the frame 11: six second hexagonal tiles 22 are placed in the second layer 50 receptacles; and nine second hexagonal tiles 22 are placed in the free fourth layer receptacles 70. Six third hexagonal tiles 32, each third hexagonal tile 32 has six sides, and wherein each third hexagonal tile 32 comprises of one centralized path 32*a*, the centralized path 32*a* defines a blocked fixed central axis point 33, each third hexagonal tile 32 defines six satellite landing spots 34 that surround the blocked fixed central axis 33 and six outer landing spots 36 that extend from each satellite landing spot 34 toward the sides of each third hexagonal tile 32, and wherein the six third hexagonal tiles 32 are placed in the free third layer 60 receptacles of the frame 11. A plurality of player pieces (not shown in figures) that are to be placed on the spots 15, 34 and 36 of the tiles 22, 32 and 36 when the game is played. Two dice 80 that are used to calculate the number of spots that a player piece has to be moved in the game. And, an instruction object (not shown in the figures) that defines the rules of the game.

The dice of the present game are six sided.

The instruction object of the game can be a booklet, an online instruction, a pamphlet or any other object that can instruct a reader with the instructions of the game.

The method of using the board game of the present invention is as follows: Providing the board game; Providing at least two players; instructing each player of the game that they are to start in one side of the frame 11, each player's side of the frame 11, and reach the opposite side of the frame 11; instructing each player that they will be able to initiate their game from their side of the board game from any path available on their side; instructing each player that the game will be played sequentially amongst the players in only one specific rotation; instructing each player that once a player piece is touched that that player piece must be played; instructing each player that if a player piece is in a specific tile that that specific tile cannot be lifted, exchanged or rotated; instructing each player that upon their turn to roll the dice that they will be able to move the dice only linearly, yet they can move their player piece in either direction in accordance to the number rolled on each dice, and that if their player piece cannot be moved in any direction because the number rolled on an individual dice does not have a linear spot available because a path is blocked, for whatever reason, then that the player piece shall remain in place; instructing each player that in addition to moving their player piece in accordance to the roll of the dice that they will also have to rotate a tile 60 degrees clockwise within a receptacle, yet that they cannot rotate a tile that has a game piece on the tile, and that they can move a tile between the two dice moves; instructing each player that if a number that they roll on a dice allows them to move their player piece and land on a player piece of a competitor, then that the competitor's player piece would be eaten and the competitor would have to start from his side again with the player piece eaten, yet if the number does not land on the competitor, the player piece would count the spot in which the competitor is on, yet it would not eat the competitor's player piece; instructing the players that they get an extra roll if they roll a double, a double means that each dice shows the same number as the other dice; instructing all players to choose their specific piece to commence game and decide the manner in which to select whom rolls first; and instructing all players that the first player to get from their side of the board game to the other side of the game wins.

The game can be played by having each player select more than one game piece so that all players have the same number of game pieces and instructing all players that the first person whom gets all of his game pieces to the other side wins. Instructing the players that they can never have two player pieces land on the same landing spot when the players plays with more than one player piece.

An advantage of the present invention is that it provides a board game that is in constant flux, for the landscape of the game changes upon every roll of the dice of the players.

Another advantage of the present invention is that it provides a board game that improves each player's critical thinking.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. A hexagonal board game, the game comprises:

a frame that defines 37 hexagonal receptacles, wherein the receptacles are connected to each other in a honeycomb pattern, the receptacles are connected in the following manner, a first receptacle is the central axis and first layer, 6 receptacles are attached to the first layer forming a second layer, 12 receptacles are attached to the second layer forming a third layer, and 18 receptacles are attached to the third layer form a fourth layer, each hexagonal receptacle defines interlocks and the interlocks are used to connect the hexagonal receptacles to each other when setting up the frame, the frame upon being set up defines 37 tile place holders;

16 first hexagonal tiles, each first hexagonal tile has a top left, a top, a top right, a bottom right, a bottom, and a bottom left side, and wherein each first hexagonal tile comprises of a first path that defines three linear landing spots and the first path starts on the top left side and ends on the bottom left side of each first hexagonal tile, a second path that defines 5 linear landing spots and the second path starts on the top side and ends on the bottom side of each first hexagonal tile, and a third path that defines 3 linear landing spots and the third path starts on the top right side and ends on the bottom right side each first hexagonal tile, and wherein the first hexagonal tiles are placed on the frame at the following locations of the frame:

1 first hexagonal tile is placed in the first layer receptacle's tile place holder;

6 first hexagonal tiles are placed in the third layer receptacles' tile place holders so that a free third layer receptacle separates each first hexagonal tile; and 9 first hexagonal tiles are placed in the fourth layer receptacles' tile place holders so that a free fourth layer receptacle separates each first hexagonal tile on the fourth layer;

15 second hexagonal tiles, each second hexagonal tile has a top left, a top, a top right, a bottom right, a bottom, and a bottom left side, and wherein each second hexagonal tile comprises of a first path that defines one landing spot and the first path starts and ends on the bottom left side of each second hexagonal tile, a second path that defines four linear landing spots and the second path starts on the top left side and ends on bottom side of each second hexagonal tile, a third path that defines four linear landing spots and the third path starts on the top side and ends on the bottom right side of each second hexagonal tile, and a fourth path that defines one landing spot and the fourth path starts and ends on the top right side of each second hexagonal tile, and wherein the second hexagonal tiles are placed on the frame at the following locations of the frame:

6 second hexagonal tiles are placed in the second layer receptacles' tile place holders; and 9 second hexagonal tiles are placed in the free fourth layer receptacles' tile place holders;

6 third hexagonal tiles, each third hexagonal tile has six sides, and wherein each third hexagonal tile comprises of one centralized path, the centralized path defines a blocked fixed central axis point, each third hexagonal tile defines 6 satellite landing spots that surround the blocked fixed central axis and 6 outer landing spots that extend from each satellite landing spot toward the sides of each third hexagonal tile, and wherein the 6 third hexagonal tiles are placed in the free third layer receptacles' tile place holders of the frame;

a plurality of player pieces that are to be placed on the spots of the tiles when the game is played;

2 dice that are used to calculate the number of spots that a player piece is moved in the game; and an instruction object that defines the rules of the game.

2. A method of playing a hexagonal board game, comprising:

Providing a hexagonal board game that comprises:

a frame that defines 37 hexagonal receptacles, wherein the receptacles are connected to each other in a honeycomb pattern, the receptacles are connected in the following manner, a first receptacle is the central axis and first layer, 6 receptacles are attached to the first layer forming a second layer, 12 receptacles are attached to the second layer forming a third layer, and 18 receptacles are attached to the third layer form a fourth layer, each hexagonal receptacle defines interlocks and the interlocks are used to connect the hexagonal receptacles to each other when setting up the frame, the frame upon being set up defines 37 tile place holders;

16 first hexagonal tiles, each first hexagonal tile has a top left, a top, a top right, a bottom right, a bottom, and a bottom left side, and wherein each first hexagonal tile comprises of a first path that defines three linear landing spots and the first path starts on the top left side and ends on the bottom left side of each first hexagonal tile, a second path that defines 5 linear landing spots and the second path starts on the top side and ends on the bottom side of each first hexagonal tile, and a third path that defines 3 linear landing spots and the third path starts on the top right side and ends on the bottom right side each first hexagonal tile, and wherein the first hexagonal tiles are placed on the frame at the following locations of the frame:

1 first hexagonal tile is placed in the first layer receptacle's tile place holder;

6 first hexagonal tiles are placed in the third layer receptacles' tile place holders so that a free third layer receptacle separates each first hexagonal tile; and 9 first hexagonal tiles are placed in the fourth layer receptacles' tile place holders so that a free fourth layer receptacle separates each first hexagonal tile on the fourth layer;

15 second hexagonal tiles, each second hexagonal tile has a top left, a top, a top right, a bottom right, a bottom, and a bottom left side, and wherein each second hexagonal tile comprises of a first path that defines one landing spot and the first path starts and ends on the bottom left side of each second hexagonal tile, a second path that defines four linear landing spots and the second path starts on the top left side and ends on bottom side of each second hexagonal tile, a third path that defines four linear landing spots and the third path starts on the top side and ends on the bottom right side of each second hexagonal tile, and a fourth path that defines one landing spot and the fourth path starts and ends on the top right side of each second hexagonal tile, and wherein the second hexagonal tiles are placed on the frame at the following locations of the frame:

6 second hexagonal tiles are placed in the second layer receptacles' tile place holders; and 9 second hexagonal tiles are placed in the free fourth layer receptacles' tile place holders:

6 third hexagonal tiles, each third hexagonal tile has six sides, and wherein each third hexagonal tile comprises of one centralized path, the centralized path defines a blocked fixed central axis point, each third hexagonal tile defines 6 satellite landing spots that surround the blocked fixed central axis and 6 outer landing spots that extend from each satellite landing spot toward the sides of each third hexagonal tile, and wherein the 6 third hexagonal tiles are placed in the free third layer receptacles' tile place holders of the frame;

a plurality of player pieces that are to be placed on the spots of the tiles when the game is played;

2 dice that are used to calculate the number of spots that a player piece is moved in the game; and an instruction object that defines the rules of the game;

providing one of said player pieces each to at least two players;

instructing each player of the game that they are to start in one side of the frame, each player starts from his or her own side of the frame, and reach the opposite side of the frame;

instructing each player that they will be able to initiate their game from their side of the board game from any path available on their side;

instructing each player that the game will be played sequentially amongst the players in only one specific rotation;

instructing each player that once a player piece is touched that that player piece must be played;

instructing each player that if a player piece is in a specific tile that that specific tile cannot be lifted, exchanged or rotated;

instructing each player that upon their turn to roll the dice that they will be able to move the dice only linearly, yet they can move their player piece in either direction in accordance to the number rolled on each dice, and that if their player piece cannot be moved in any direction because the number rolled on an individual dice does not have a linear spot available because a path is blocked, for whatever reason, then that the player piece shall remain in place;

instructing each player that in addition to moving their player piece in accordance to the roll of the dice that they will also have to rotate a tile 60 degrees clockwise within a receptacle, yet that they cannot rotate a tile that has a game piece on the tile, and that they can move a tile between the two dice moves;

instructing each player that if a number that they roll on a dice allows them to move their player piece and land on a player piece of a competitor, then that the competitor's player piece would be eaten and the competitor would have to start from his side again with the player piece eaten, yet if the number does not land on the competitor, the player piece would count the spot in which the competitor is on, yet it would not eat the competitor's player piece;

instructing the players that they get an extra roll if they roll a double, a double means that each dice shows the same number as the other dice;

instructing all players to choose their specific piece to commence game and to select whom rolls first; and instructing all players that the first player to get from their side of the board game to the other side of the game wins.

3. The method of playing a hexagonal board game of claim 2, comprising:

having each player select more than one game piece so that all players have the same number of game pieces; and instructing all players that the first person whom gets all pieces to the other side wins.

4. The method of playing a hexagonal board game of claim 3, comprising instructing each player that they can never have two player pieces on the same landing spot.

* * * * *